United States Patent [19]

Yokoyama

[11] 3,991,467

[45] Nov. 16, 1976

[54] CARPETING TRIMMER

[76] Inventor: Kiyofumi Yokoyama, No. 83, Nakazaki, Kita, Osaka, Japan

[22] Filed: Sept. 3, 1975

[21] Appl. No.: 610,004

[52] U.S. Cl. ..... 30/293; 30/294; 30/335

[51] Int. Cl.[2] ..... B26B 1/08; B26B 3/08

[58] Field of Search ..... 30/335, 293, 294

[56] References Cited

UNITED STATES PATENTS

| | | | |
|---|---|---|---|
| 2,607,115 | 8/1952 | Iovinelli | 30/293 |
| 2,666,986 | 1/1954 | Codianne | 30/293 |
| 2,772,474 | 12/1956 | Hill et al. | 30/293 |
| 2,967,354 | 1/1961 | Ahlborn | 30/293 |
| 3,363,314 | 1/1968 | O'Brien | 30/293 |
| 3,535,786 | 10/1970 | Sanders | 30/293 |
| 3,581,397 | 6/1971 | Kochanowski | 30/293 |
| 3,605,267 | 9/1971 | Brenner | 30/293 |
| 3,726,010 | 4/1973 | Yokoyama | 30/335 |
| 3,772,785 | 11/1973 | Fischer | 30/293 |
| 3,799,225 | 3/1974 | Chenel | 145/46 |

*Primary Examiner*—Al Lawrence Smith
*Assistant Examiner*—J. T. Zatarga
*Attorney, Agent, or Firm*—Wenderoth, Lind & Ponack

[57] ABSTRACT

A carpeting trimmer which includes a body consisting of a base having a flat bottom and upwardly extending grip, a channel extending through the body and slidably accommmodating a blade, a base plate mounted below the base of the body, and a disc having a screw threaded in the bottom of the base. The base plate is movable towards and away from the bottom of the base in such a manner that the front edge of the base plate retreats behind the front edge of the base. The disc is arranged between the bottom of the base and the base plate for supporting the latter.

11 Claims, 8 Drawing Figures

CARPETING TRIMMER

The present invention relates to carpeting trimmers, and more particularly to a trimmer for severing the excess of carpeting of various types and thicknesses.

Upon installation of carpeting on the floor, the outer edge of the carpeting must be carefully trimmed so as to conform the shape of the floor and to avoid gaps between the wall and the edge of the carpeting. However such trimming requires considerable skill since the thickness of the carpeting may vary. In a conventional cutter having an adjustable blade, the blade is projected or retracted so as to meet the thickness of a carpet. A thicker carpet, however, forms a larger curve at the upturned portion abutting the floor-wall juncture. On the other hand a thinner carpet forms a smaller curve. Therefore when cutting the predetermined position along the floor-wall juncture, there will exist a gap between the wall and the edge of the thicker carpet, while the thinner carpet will fit.

An object of the invention is to provide a trimmer having an adjustable means for the projecting position of the blade in order to effect a trim fit of the carpeting in accordance with its thickness.

A further object of the invention is to provide a trimmer easy to handle and simple in construction.

Other objects and features of the invention will be apparent from the following description of the invention with reference to the accompanying drawings, in which.

Throughout the drawings similar parts and elements are shown by the similar reference numerals and letters.

Figure 1:
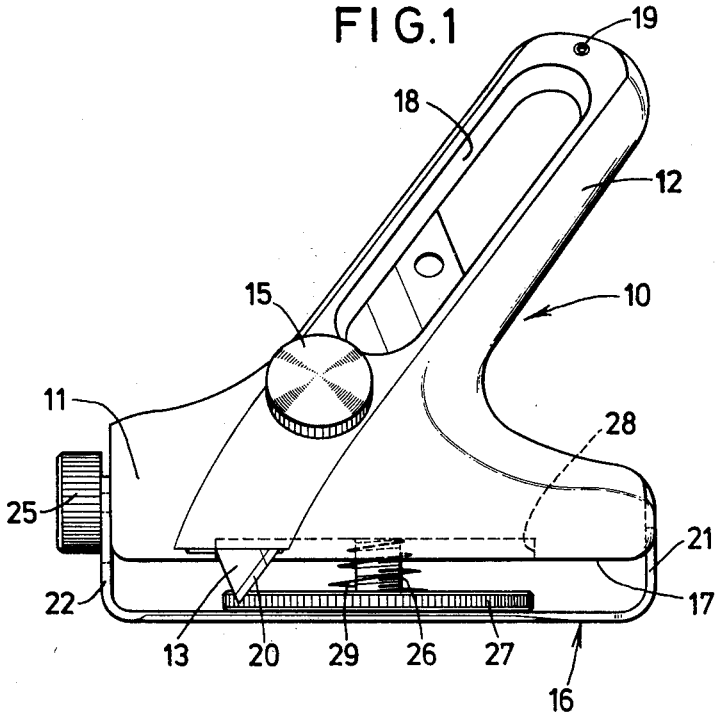
FIG. 1 is a front elevation of a trimmer of the invention.

Referring now to FIGS. 1 through 4, a trimmer of the invention comprises a body 10 made of light alloy consisting of a base 11 and an integral handle or grip 12, a blade 13 slidable in a channel 14 extending through the body 10 and retained at its position by means of a thumb screw 15, and a base plate 16 adjustable towards and away from a bottom 17 of the base 11.

Figure 2:
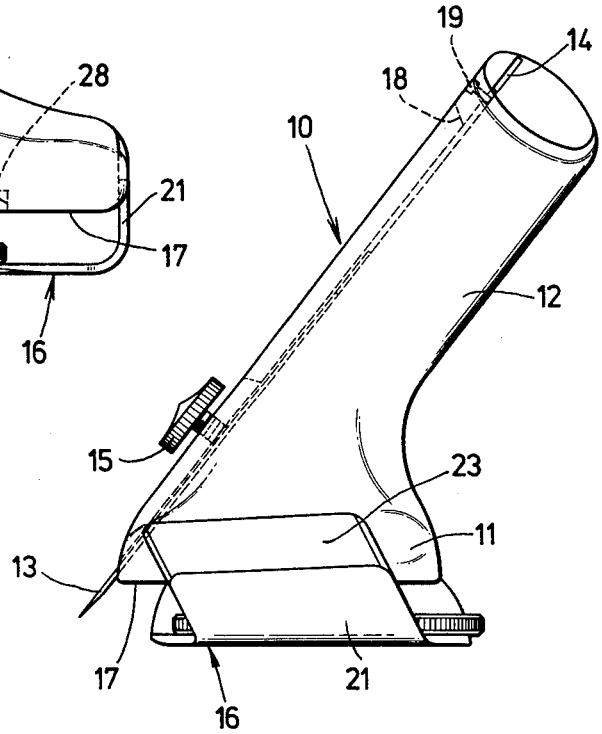
FIG. 2 and FIG. 3 are side elevations of the same.

In said grip 12 a longitudinal opening 18 communicates with said channel 14 for the convenience of adjusting the amount of the blade 13 projecting from the front edge of the base 11. At the position below said opening 18, the thumb screw 15 is threaded with its inner end projecting in the channel 14 to engage the surface of the blade 13 in order to retain the latter, as best seen in FIG. 2. Upon adjustment of the blade 13, the thumb screw 15 is loosened. To prevent the blade 13 from leaving of the channel 14 when the screw 15 is loosened, the bottom of the channel 14 may be magnetized. Also a stop 19 may be provided across the channel 14 at its upper end, as shown in FIG. 2.

Figure 3:
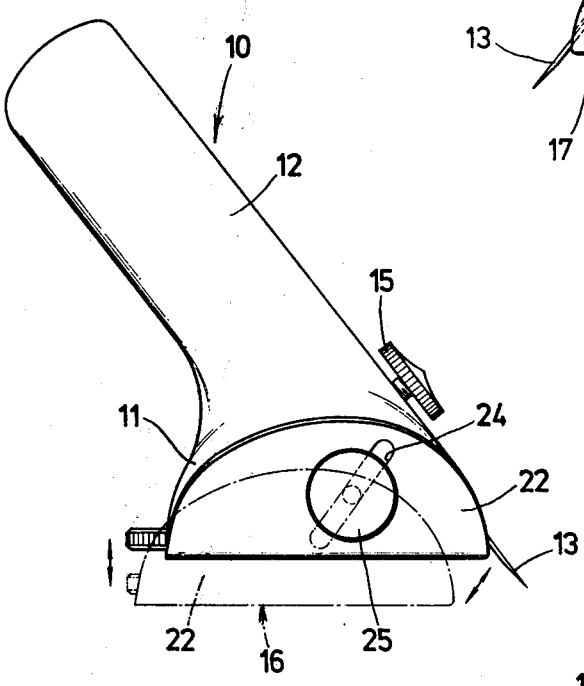

As appears in FIGS. 2 and 3, the grip 12 has a backward inclination at a acute angle, preferably at about 60°, with respect to the flat bottom 17. The result is that the blade 13 also inclines at the same angle.

As shown in FIG. 1, preferably, the grip 12 is inclined laterally towards the sliding direction of the present trimmer, at about 60° with respect to the flat bottom 17, for the convenience of sliding the trimmer along a carpet surface by gripping the handle 12. This lateral inclination causes a cutting edge 20 of the blade 13 to incline also in the lateral direction at the same angle, thus permitting smoother cutting of a carpet by decreasing the resistance of the cutting edge 20 against the carpet (as compared to a conventional cutter having a cutting edge disposed at a right angle).

The base plate 16 has a flat bottom portion with integral right and left upturned portions 21 and 22 slidably fitted to both side faces of the base 11 of the body 10.

As shown in FIG. 2, a shallow inclined recess 23 may be provided in the one side face of the base 11. The upturned portion 21 is so formed as to fit in said recess 23 which serves as a guide for the base plate 16 when moved towards or away from the bottom 17 of the base 11, as mentioned hereinafter in detail.

In the left upturned portion 22 of the plate 16 is provided with a slanted slot 24 in which is inserted a thumb screw 25 which is further threaded into the other side face of the base 11 of the body 10. When the thumb screw 25 is tightened, the base plate 16 is held in its position, and when loosened, the base plate 16 is released and movable. The movement of the plate is permitted along the slanted slot 24, as shown by the arrow and dot-dash line in FIG. 3, and is limited by the ends of the slot 24. As will be understood, the inclination of the slot 24 is the same as that of said preferable recess 23.

Figure 4:
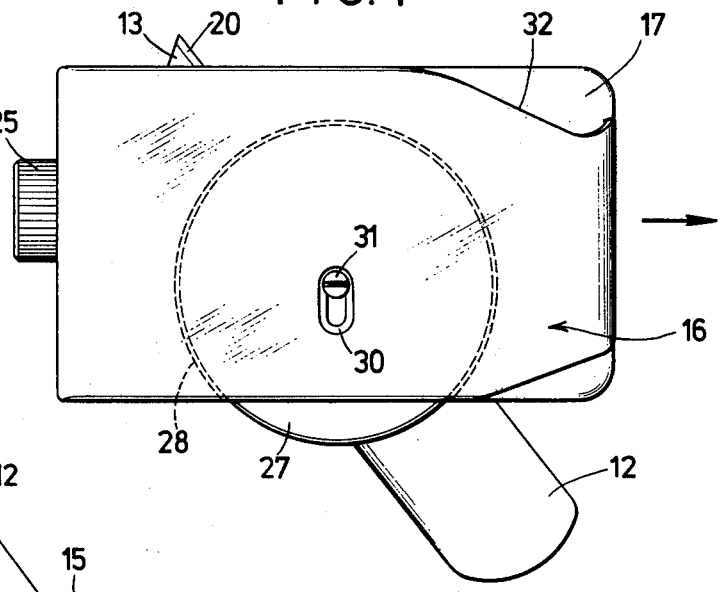
FIG. 4 is a bottom plan of the same incorporating a slight modification.

In the bottom 17 of the base 11 is a threaded screw 26 having a disc 27. As shown in FIG. 4, the disc 27 has a diameter substantially the same as the width of the base plate 16, and is arranged in such a manner that a part of the outer periphery projects outwardly from the backward edge of the base plate 16 for the convenience of revolving it. A knurling may be provided about the outer periphery of the disc 27. The disc 27 is provided for supporting and holding the base plate 16 during sliding along a carpet surface. After setting the base plate 16 at a desired position by means of the set screw 25, the disc is adjusted so as to engage the inner face of the base plate 16 by turning the disc and integral screw 26.

Figure 5:
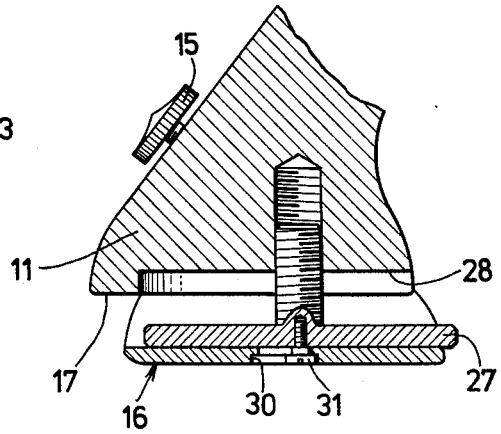
FIG. 5 is a vertical section showing the main part of FIG. 4.

As shown in FIGS. 1, 4 and 5, in the bottom 17 of the base 11 is provided with a circular depression 28 complementary to the inward portion of the disc 27 in order to accommodate the latter when the inner face of the plate 16 contacts to the bottom 17 of the base 11.

A coil spring 29 may be inserted around the screw 26 between the bottom of the depression 28 and the disc 27, as illustrated in FIG. 1, for preventing face-to-face tight engagement of the inner flat surface of the disc 27 against the flat bottom of the depression 28, and for avoiding the difficulty of releasing the disc from the bottom of the depression. For the same purpose, a washer or any other cushioning means can be provided on the inner face of the disc or the bottom of the depression.

In FIGS. 4 and 5, a preferable modification is shown. An oblong hole 30 is provided in the base plate 16, and a screw 31 is inserted through the disc hole 30 to connect the base plate 16 to the disc 27 in a slidable engagement with each other within the range defined by the ends of the oblong hole 30. By this arrangement, according to the revolution of the disc 27, the base plate 16 moves up and down simultaneously with the movement of the disc.

As shown in FIG. 4, a cut-away portion 32 may be provided in the front corner of the base plate 16, the action of which will be explained hereinafter in detail.

The cutter blade 13 in the channel 14 may be any known one, but preferably has a cutting edge 20 along one side or both sides throughout the length thereof together with grooves thereacross at predetermined spaces to make possible breaking off the portion of the blade the edge of which has become dull.

Figure 6:
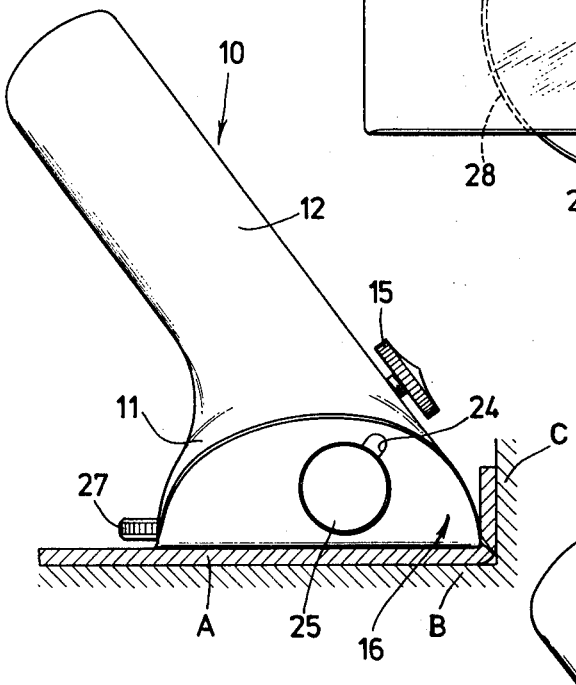
FIGS. 6 through 8 are side views showing the trimmer in use.
Figure 7:
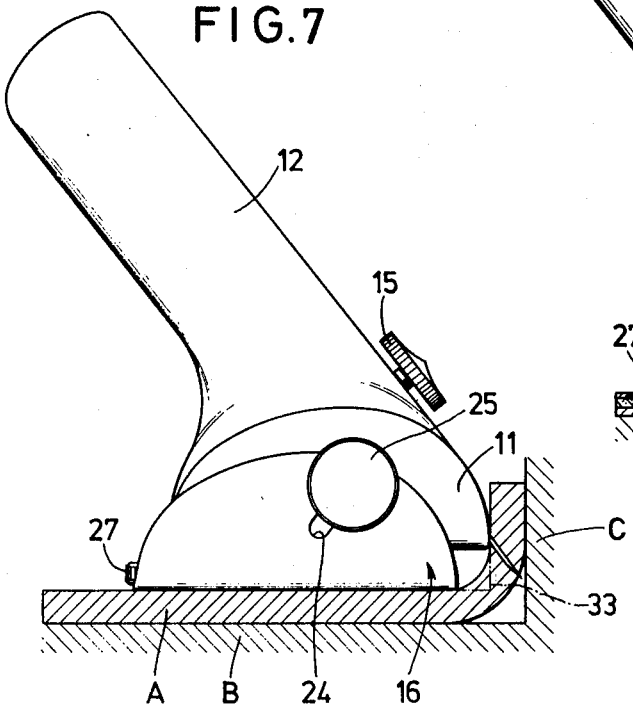

In operation, initially a carpet A is laid on a floor B and upturned so as to conform to the juncture between the floor B and wall C. The carpet A has a different curve at the floor-wall juncture, depending on the thickness of the carpet, as shown in FIGS. 6 and 7. In the case of thinner carpet as of FIG. 6, the disc 27 is turned and adjusted towards the bottom 17 of the base 11. The thumb screw 25 is then loosened and the base plate 16 is moved towards the bottom 17 of the base 11 so as to tightly contact with the disc 27. The screw 25 is then tightened to fix the base plate 16. After this the thumb screw 15 is loosened to permit the movement of the blade 13 through the opening 18. The amount of projection of the blade 13 is adjusted so as to meet the thickness of the carpet A. When the adjustments are complete, and the trimmer is slid along the floor-wall juncture while gripping the handle 12 and pressing the trimmer against the wall C as well as the surface of the carpet A, thereby severing the upturned excess of the carpet A.

In the case of thicker carpet as of FIG. 7, the carpet A has a larger curve at the floor-wall juncture as shown. In such a condition, the thumb screw 25 is loosened, and the base plate 16 is moved away from the bottom 17 of the base 11 so that the space between the bottom 17 and the base plate 16 is approximately the same as the thickness of the carpet A. If the base pate 16 was so arranged that it positions just below the bottom 17 when moved away therefrom, the carpet A must be folded at right angles at the floor-wall juncture, as shown by the dot-dash line 33 in FIG. 7. As readily be understood, this will be impossible. The slant slot 24 makes possible the adjustment of the base plate 16 suitable for a curve formed on the carpet at the floor-wall juncture.

After this the screw 25 is tightened, and the disc 27 is turned so as to tightly contact the inner face of the base plate 16. The thumb screw 15 is then loosened for the adjustment of the blade 13 so as to meet the thickness of the carpet A. After these adjustments the trimmer is slid along the floor-wall juncture in a similar way as mentioned before. During the operation, since the base plate 16 is firmly supported by the disc 27, there will not occur any rattling of the base plate. Furthermore, since almost all the part of the resilient blade 13 is accommodated in the narrow channel 14, the trimmer is not induced in the incorrect direction away from the floor-wall juncture which might often occur because of to the resiliency of the blade during cutting.

The above-mentioned, cut-away portion 32 acts as means for amending the curve of the carpet at the floor-wall juncture. It is possible that the curve on the carpet may vary at various positions thereof along the floor-wall juncture. In such a case, as the trimmer moves along the juncture in the direction shown by the arrow in FIG. 4, the carpet is gradually and smoothly amended along the front edge of the cut-away portion 32 to form a constant curve at the cutting edge 20 of the blade 13, thereby assuring exact and correct severing of the carpet.

Figure 8:
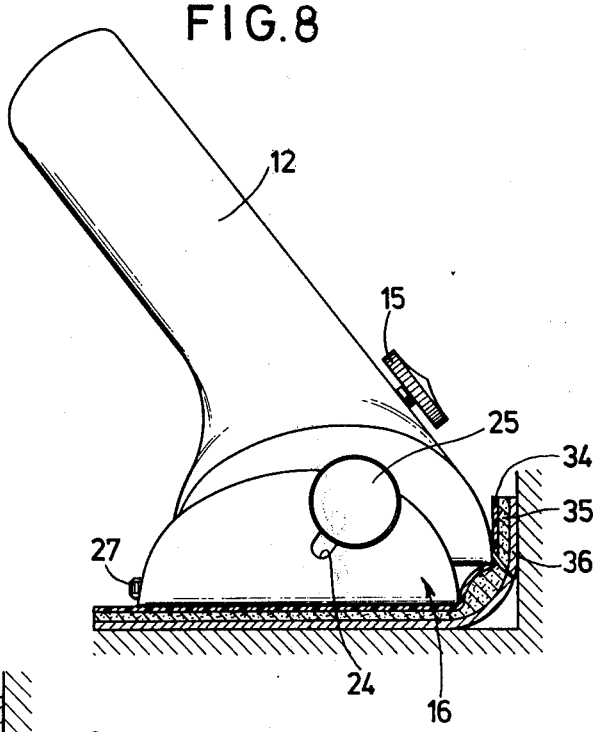

FIG. 8 shows a different type of carpeting or flooring sheet. The sheet A includes a synthetic resin surface layer 34, a cushion stuff 35 as of glass fibre, and a lining 36. When such a flooring sheet is folded at the juncture, the sheet curves reversely to an ordinary woolen carpet as shown, because the surface layer 34 does not shrink. The trimmer of the present invention can be applied to such a sheet. The trimmer as adjusted has a space between the front edge of the base 11 and the front edge of the base plate 16. The space can accommodate such reverse curve of the sheet A as shown in FIG. 8. Of course the present trimmer can be applied to any other sheet such as wall paper.

In another usage of the trimmer, the blade 13 is withdrawn in the channel 14 and other parts are adjusted as mentioned before. The trimmer is slid along the floor-wall juncture in the same way as above. Thus the carpet has a constant curve at the juncture. Thereafter the cutting operation is performed.

As apparent from the above description, the trimmer of the present invention enables exact and correct severing of the carpet since the base plate is adjustable according to the thickness of the carpet as well as the curve formed thereon, in such a manner that the front edge of the base plate retreats behind the front edge of the base of the trimmer body. Furthermore, since the front edge of the base of the body as well as the front edge of the base plate is in linear contact with the folded portion of the carpet, the friction against the carpet can be minimized, resulting in a decrease in labour.

I claim:

1. A device for trimming carpet comprising:

a main body portion having a channel extending therethrough comprised of:

a flat-bottomed base, and a grip portion integrally formed with and extending upward at an angle from said base, said grip portion containing said channel therein;

a cutting blade slidably fitted in said channel and extensible therefrom at an acute angle to the bottom of said base;

first retaining means connected to said channel for retaining said blade in said channel;

a base plate slidably mounted on said body portion and extending below the bottom of said base, said base plate being slidable toward and away from the bottom of said base with the front edge thereof continuously positioned behind the front edge of said base;

second retaining means operatively connected to said base of said main body portion and said slidable base plate for retaining said base plate in the desired position relative to said base; and disc means threadably mounted perpendicular to the bottom of said base between said base and said base plate for supporting said base plate away from said base.

2. A device as claimed in claim 1, wherein:

said base plate has upwardly directed side portions slidably fitted around the sides of said base, at least one of said side portions having a slanted slot therethrough, the bottom of said slot positioned further from the front of said side portion than the top thereof; and said second retaining means is comprised of a thumb screw threaded into the side of said base through said slanted slot.

3. A device as claimed in claim 2, wherein said base has an angled recess in at least one side thereof at the same angle as said slanted slot in said base plate, and at least one of said upwardly directed sides of said base plate is slidably fitted in said recess.

4. A device as claimed in claim 1, wherein said disc means mounted beneath said base projects beyond the rearward edge of said base.

5. A device as claimed in claim 1, wherein said grip portion extends upward from said base at an angle inclined toward the cutting direction of said device.

6. A device as claimed in claim 1, further comprising cushioning means between the bottom of said base and the top of said disc means for preventing said disc means from completely touching the bottom of said base.

7. A device as claimed in claim 1, further comprising stop means across the end of said channel opposite the end thereof from which said cutting blade extends for preventing the removal of said cutting blade from said channel.

8. A device as claimed in claim 1, wherein the end of said channel from which said cutting blade extends is magnetized to hold said blade in said channel.

9. A device as claimed in claim 1, wherein the bottom of said base has a depression for receiving said disc means therein.

10. A device as claimed in claim 1, wherein said base plate has a cut-away portion at the forward corner thereof in the cutting direction.

11. A device as claimed in claim 1, wherein the circumference of said disc means is knurled.

* * * * *